US008141722B2

(12) United States Patent
Heroux

(10) Patent No.: US 8,141,722 B2
(45) Date of Patent: Mar. 27, 2012

(54) GARMENT HANGING DEVICE

(75) Inventor: Steve G. Heroux, South Burlington, VT (US)

(73) Assignee: HIP Innovations, LLC., Williston, VT (US)

( * ) Notice: Subject to any disclaimer, the term of this patent is extended or adjusted under 35 U.S.C. 154(b) by 122 days.

(21) Appl. No.: 12/371,235

(22) Filed: Feb. 13, 2009

(65) Prior Publication Data

US 2010/0206827 A1 Aug. 19, 2010

(51) Int. Cl.
*A41D 27/22* (2006.01)

(52) U.S. Cl. ..... 211/116; 211/113; 223/88

(58) Field of Classification Search ..... 211/85.3, 211/89.01, 96, 104, 113, 116, 118, 119.004, 211/123, 124, 175; 223/85, 86, 88, 89, 94, 223/DIG. 1, DIG. 2, DIG. 4; 248/215, 304, 248/308, 340; D6/315, 323, 328
See application file for complete search history.

(56) References Cited

U.S. PATENT DOCUMENTS

| | | | | |
|---|---|---|---|---|
| 2,401,835 | A | 6/1946 | McFall | |
| 2,609,104 | A * | 9/1952 | Leach | 224/482 |
| 2,699,263 | A * | 1/1955 | Ore | 211/113 |
| 2,709,005 | A * | 5/1955 | Eckstein | 211/113 |
| 2,714,965 | A * | 8/1955 | Fitzkee et al. | 211/113 |
| 4,037,728 | A * | 7/1977 | Cameron | 211/124 |
| 4,129,218 | A | 12/1978 | Koellner | |
| 4,308,962 | A | 1/1982 | Fahmi | |
| 4,709,838 | A * | 12/1987 | Campbell | 223/85 |
| 4,872,568 | A | 10/1989 | Lehmann | |
| 4,948,019 | A | 8/1990 | Rodum | |
| 4,953,717 | A | 9/1990 | Rosch | |
| 4,972,961 | A | 11/1990 | Roesch | |
| 5,065,915 | A * | 11/1991 | Rosch | 223/89 |
| 5,072,837 | A | 12/1991 | Rosch | |
| 5,107,996 | A | 4/1992 | Whittaker | |
| 5,501,345 | A * | 3/1996 | Hilstolsky et al. | 211/113 |
| 5,836,486 | A * | 11/1998 | Ohsugi | 223/85 |
| 5,901,888 | A | 5/1999 | Schneider et al. | |
| 6,942,111 | B2 | 9/2005 | Harrell | |
| 7,080,727 | B1 * | 7/2006 | Sanderson | 198/680 |
| 7,134,561 | B2 | 11/2006 | Schneider et al. | |
| 2005/0109721 | A1 * | 5/2005 | Schneider et al. | 211/118 |

FOREIGN PATENT DOCUMENTS

| | | | |
|---|---|---|---|
| DE | 3335939 | A1 * | 4/1985 |
| JP | 4-146704 | A | 5/1992 |

* cited by examiner

*Primary Examiner* — Michael Safavi
*Assistant Examiner* — Joshua Rodden
(74) *Attorney, Agent, or Firm* — Bacon & Thomas, PLLC

(57) ABSTRACT

A garment hanging device includes an elongated bar, having a plurality of receptacles defined in the bar, each of which can receive a garment hanger. Each receptacle has a receiving portion open at the top edge of the bar, and a retaining portion between the top and bottom edges being connected with the receiving portion. At least one hook is provided, having a coupling end pivotably coupled to the bar, a hooking portion extending from the coupling end through an apex portion opposite the coupling end to a terminal end. A distance between the hook's pivot point on the bar and a corresponding receptacle corresponds to a distance between the coupling end and the apex portion such that the hook is flexed and pivoted into a stowed position wherein the apex portion is disposed within the corresponding receptacle, and into a deployed position wherein the apex portion is removed from the corresponding receptacle.

15 Claims, 7 Drawing Sheets

GARMENT HANGING DEVICE

FIELD OF THE INVENTION

The present invention relates to a device for hanging clothing or other articles. More particularly, the present invention relates to a device for simultaneously hanging and storing several garment hangers on a closet rod in either a vertically or a horizontally spaced manner.

BACKGROUND

Storage of clothing and other articles is a problem faced to one degree or another by virtually every person in virtually every society of the modern world. For example, numerous types of clothing articles are commonly stored in clothes closets, suspended from a clothing hanger which is in turn suspended from, or hung on, a closet rod. Other articles such as clothing accessories and other items may be similarly stored.

Hanging clothing articles in this manner is desirable for clothing articles which might become creased or wrinkled if folded and stored laying flat, such as in a drawer or on a closet shelf. For example, shirts, slacks, jackets, sweaters, blouses, dresses, among numerous other clothing articles, may be stored in a hanging manner.

However, closet space in many dwellings is limited, and therefore space available for hanging clothes may be limited as well. Often, for example, space for hanging clothes within a clothes closet is limited to a single closet rod spanning the length of the closet.

Accordingly, a limited number of clothes may be hung on a single closet rod when the clothes are hung on clothes hangers suspended side-by-side on the single bar.

One solution to this problem has been provided in the form of an elongated bar having a pair of hooks, attached respectively at each end of the bar, for hanging the bar from a closet rod. A number of holes are provided through the bar for insertion of plural clothes hangers, such that when the bar is hung on the closet rod by only a single hook, clothing articles hung on several hangers are suspended in a generally vertical arrangement along the rod and below the hook. While functional, the task of threading a garment hanger hook through a through-hole in such an apparatus may be difficult, and may result in dropping a garment from the garment hanger as the garment hanger is turned or oriented, for insertion of the hook through the through-hole, into positions not suited for retaining the hanging garment.

Moreover, when such a bar is hung, by a single hook, in the vertical position, the second hook simply dangles below the bar, serving no function. The dangling hook may snag clothing or other items, in particular the clothes or hangers that are suspended from the device.

Hence, it is desirable to provide an improvement for the known through-holes and to provide a mechanism for the hooks to be positionable, and securable, in a "stowed" position such that interference of the hooks may be avoided. Further, the ability to place the hooks into a "stowed" position may improve the compactness of a hanging device for better storage or packaging.

SUMMARY

In a garment hanging device of the present invention, an elongated bar is provided having a first and a second end, and a top and a bottom edge extending between the first and second ends in a longitudinal direction. At least one hook is pivotably coupled to an end of the elongated bar. In an embodiment, first and second hooks are pivotally coupled to the first and second ends of the elongated bar, and are configured to be removably hooked over a closet rod such that the bar may be suspended from the closet rod by the first hook, the second hook, or both hooks.

A plurality of hanger receptacles are defined, spaced apart from one another, in said elongated bar. Each of the hanger receptacles has a receiving portion open at the top edge of the elongated bar, and a retaining portion. That is, generally speaking, each hanger receptacle has an opening at a top edge of the elongated bar (for receiving the hook of a garment hanger or the like), and a retaining portion below the top edge opening. For example, a receiving portion (such as the top opening or slot) has a length in the longitudinal direction of the bar for insertion of a garment hanger, and a wider retaining portion (the portion of the receptacle below the receiving portion or top opening) has a length in the longitudinal direction of the bar greater than the length of the receiving portion.

By this arrangement, a clothes hanger hook may be simply dropped (lowered vertically) into a hanger receptacle. Further, the clothes hanger hook is securely retained in the receptacle in either a horizontal or a vertical orientation of the bar.

The hooks are configured such that the hooks may be pivoted into a stowed position, wherein a part of the hook is engaged in one of the receptacles. With the garment hanging device hung by a single hook in the vertical orientation, a lower hook may be pivoted into the stowed position to avoid catching a garment, garment hanger, or other item on the lower hook. Also, with the hooks pivoted into the stowed position, the garment hanging device is made more compact for storage, shipping or the like.

These and other features, aspects, and advantages of the present invention will become better understood with regard to the following description, appended claims, and accompanying drawings.

DETAILED DESCRIPTION OF VARIOUS EMBODIMENTS

The present invention is a garment hanging device 100 configured to support a plurality of clothing hangers on a single bar. The garment hanging device 100 includes at least one hook 120 for hanging the garment hanging device 100, such as from a closet rod 200. An illustrated embodiment includes a hook 120 at each end of the garment hanging device 100 such that the garment hanging device 100 is suspendable from a closet rod 200 or other clothing rod or support in a horizontal or vertical orientation.

Figure 1:
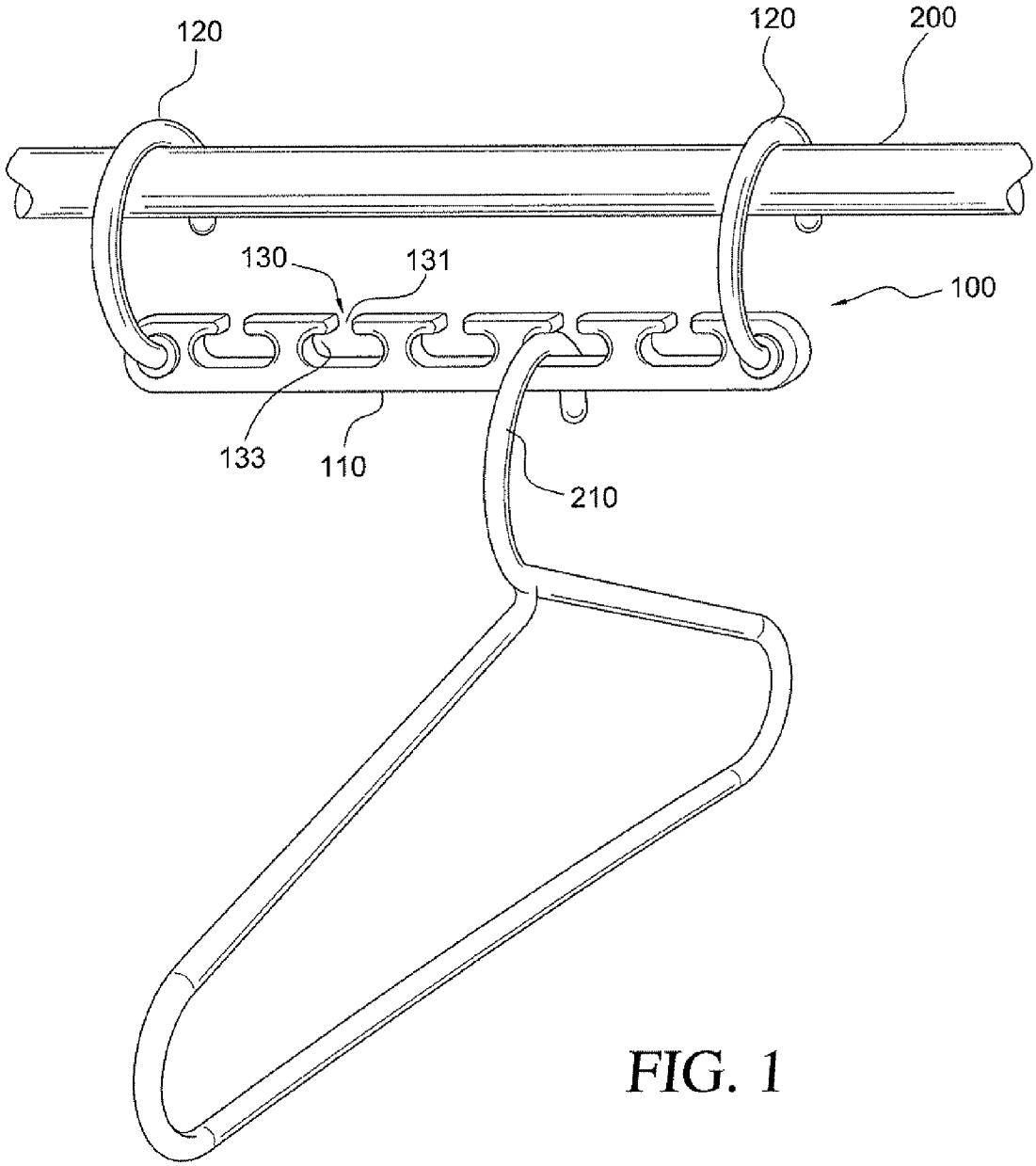
FIG. 1 is an environmental perspective view of one embodiment of a garment hanging device according to the present invention, shown in a horizontal hanging arrangement.
Figure 2:
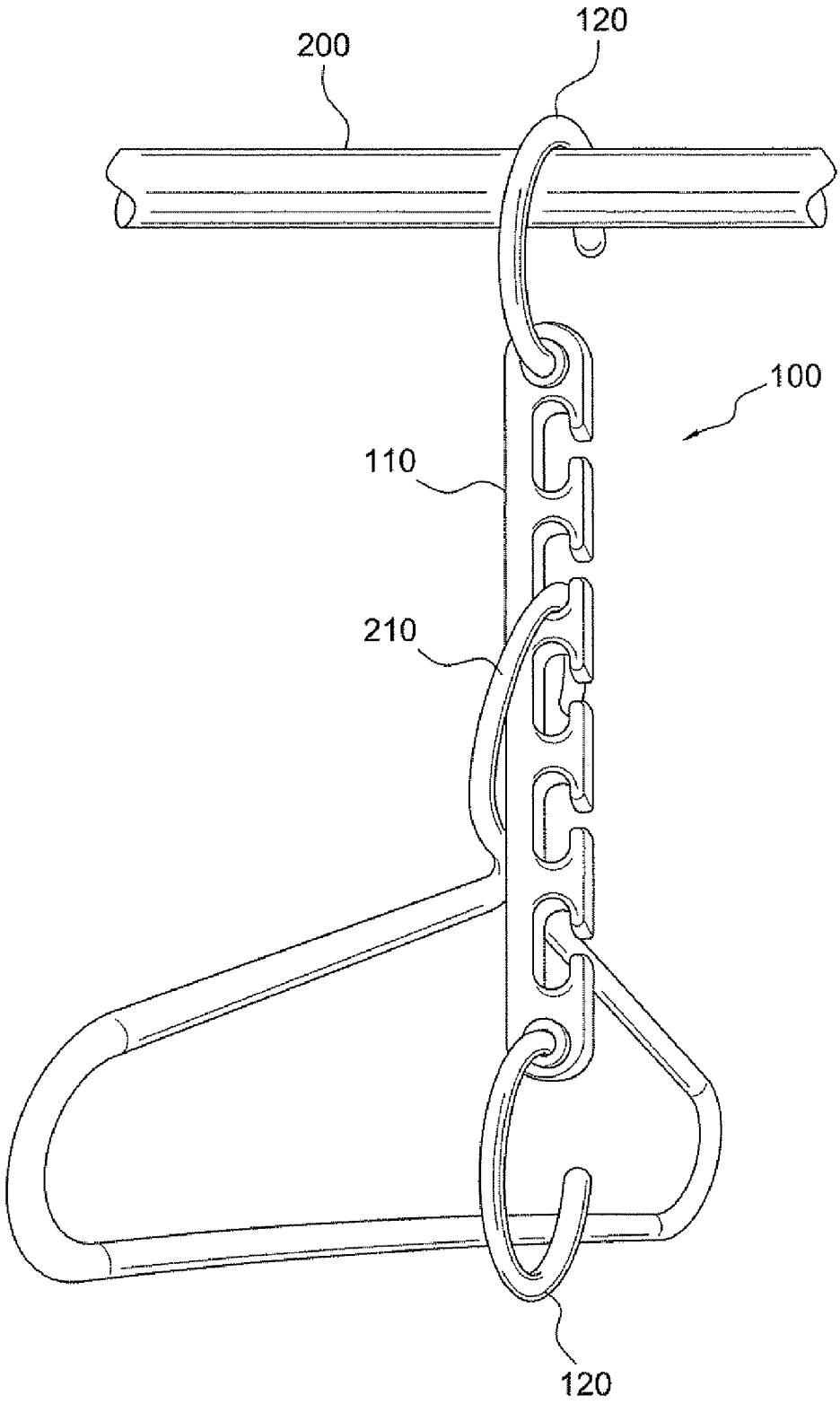
FIG. 2 is an environmental perspective view of the garment hanging device of FIG. 1, shown in a vertical hanging arrangement.
Figure 3:
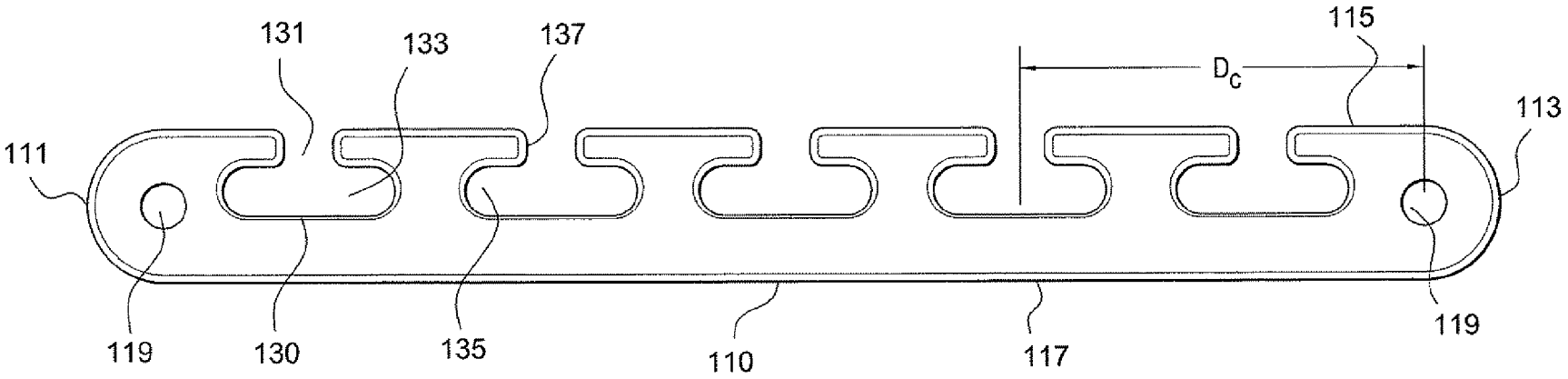
FIG. 3 is a plan view of an elongated bar element of the garment hanging device of FIG. 1.

Referring to FIGS. 1-3, one embodiment of a garment hanging device 100 is shown comprising an elongated bar 110 having a first end 111 and a second end 113, and a top edge 115 and a bottom edge 117 extending between the first and second ends 111, 113 in a longitudinal direction.

First and second hooks 120 are pivotally coupled to the first and second ends 111, 113 of the bar 110, respectively. The first and second hooks 120 are configured to be removably hooked over a closet rod 200 or another support such that the bar 110 may be suspended from the closet rod 200 by both of the hooks 120 as seen in FIG. 1, or a single hook 120 as seen in FIG. 2.

A plurality of hanger receptacles 130 are defined spaced apart from one another in the bar 110. Each of the hanger receptacles 130 has a receiving portion 131 open at the top edge 115 of the bar 110 and a retaining portion 133. The receiving portion 131 has a length in the longitudinal direction of the bar 110 for insertion of a garment hanger, and the retaining portion 133 has a length generally in the longitudinal direction that is greater than the length of the receiving portion 131.

Turning to FIG. 3, an embodiment is shown wherein the receiving portion 131 is a slot extending from the top edge 115 to the retaining portion 133, and the retaining portion 133 is a slot extending substantially along the longitudinal direction of the bar 110, between the top and bottom edges 115, 117 of the bar. The receiving portion 131 is in communication with the retaining portion 133, so that a hanger inserted into the receiving portion 131 is guided into the retaining portion 133. In one embodiment, at least one end 135 of the retaining portion 133 extends beyond a side wall 137 of the receiving portion 131. In the illustrated example, both ends of the retaining portion 133 extend beyond corresponding sides of the receiving portion, forming an inverted T-shaped receptacle.

Referring back to FIG. 2, it can be seen that when a hanger hook 210 is received in one of the receptacles 130, and the garment hanging device 100 is suspended in its vertical orientation, the hanger hook 210 is disposed in one end 135 of the retaining portion 133 whereby the hanger hook 210 is prevented from falling or becoming dislodged from the receptacle 130.

Figure 4:
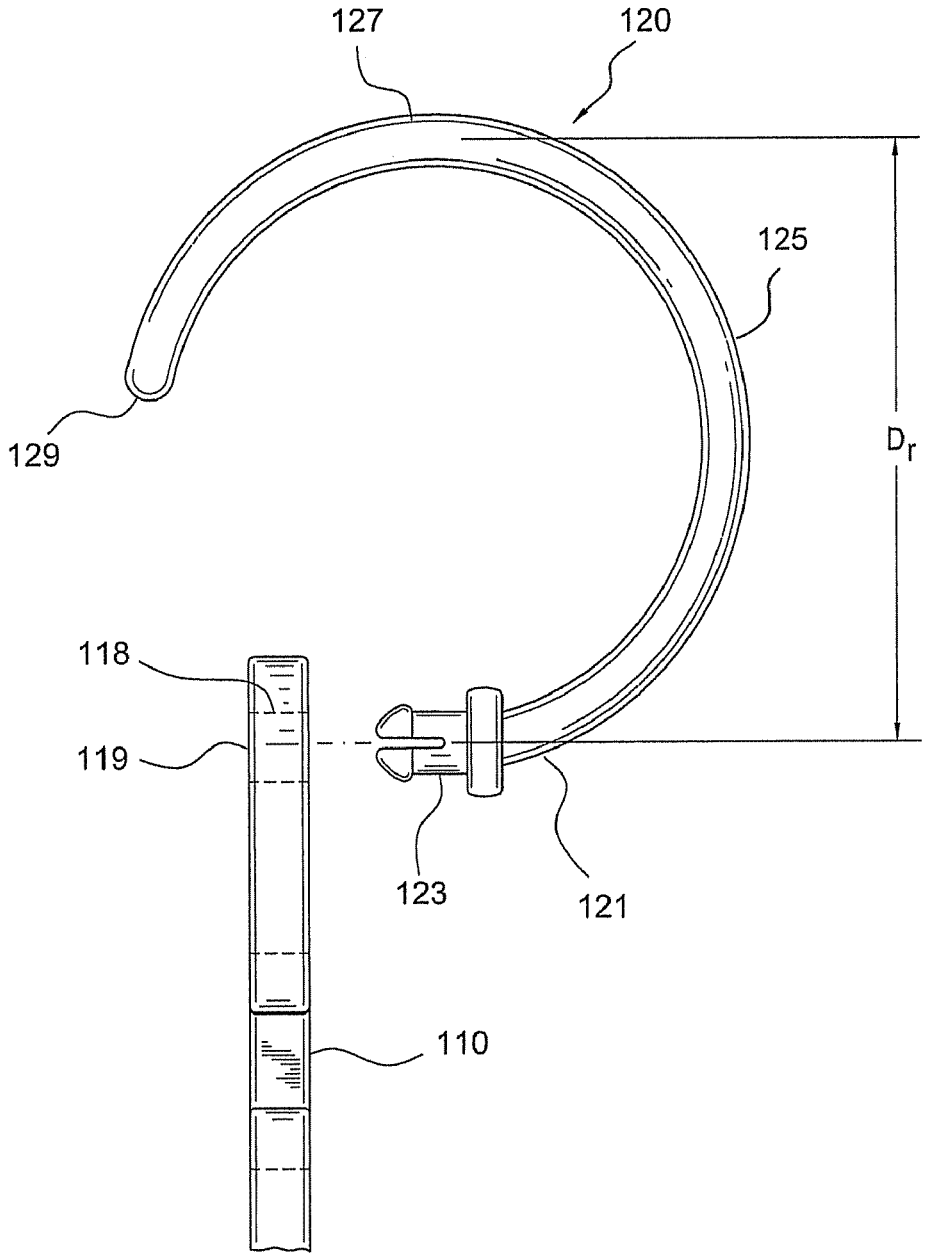
FIG. 4 is a plan view of a hook element of the garment hanging device of FIG. 1, including a partial view of the bar showing a relationship between the hook and the bar.

Referring to FIG. 4, a hook 120 is shown in greater detail having a coupling end 121 which is configured to be pivotably coupled to pivot point of the bar 110. The hook 120 may be removably coupled to the bar 110, for example by providing a snap fitting 123 at the coupling end 121. In the illustrated embodiment, the snap fitting 123 comprises a split post extending from the coupling end 121 of the hook 120 and having a tapered flange at an outer end, configured for insertion into a pivot socket 118 defined laterally into or through the bar 110 at the pivot point 119 of the bar 110.

A hooking portion 125 of the hook 120 extends from the coupling end 121, through an apex portion 127 generally diametrically opposite the coupling end 121, to a terminal end 129. In the illustrated example, the hooking portion 125 follows a generally curved or arcuate path, although other shapes including polygonal shapes may be used.

The hooks 120 are resiliently and elastically flexible from a relaxed state to a flexed state, such that a distance between the coupling end 121 and the apex portion 127 varies between the relaxed state and the flexed state.

Figure 5A:
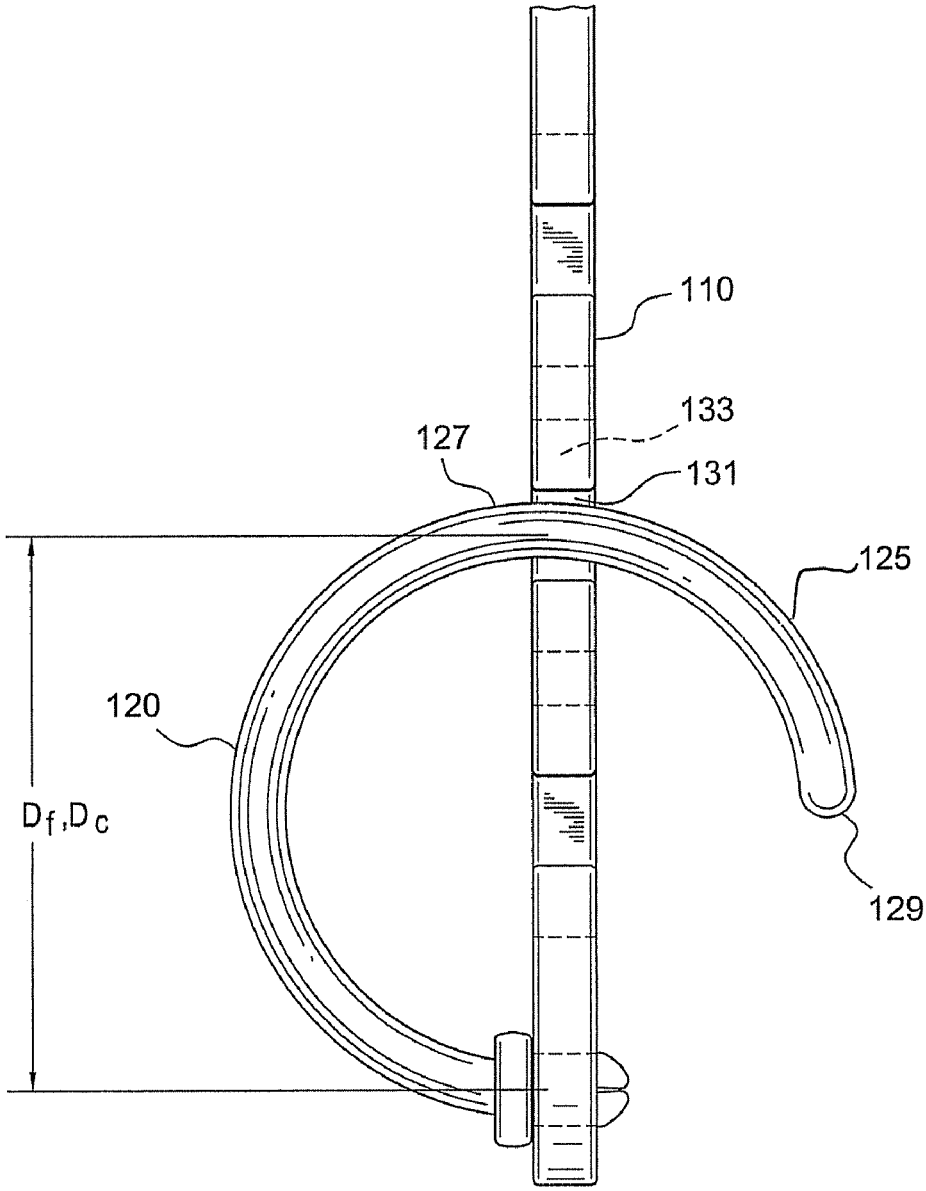
FIG. 5*a* is a partial view of the garment hanging device of FIG. 1 wherein one of the hooks is flexed into alignment with the receiving portion of one of the receptacles.

In the flexed state, as shown in FIG. 5*a*, a distance $D_f$ between the coupling end 121 and the apex portion 127 corresponds to a distance $D_c$ between the pivot point 119 and the receiving portion 131 of a corresponding one of the receptacles 130, such that when the hook 120 is pivoted to bring the apex portion 127 toward the top edge 115 of the bar 110, the apex portion 127 is aligned with the receiving portion 131 of the corresponding receptacle 130.

Figure 5B:
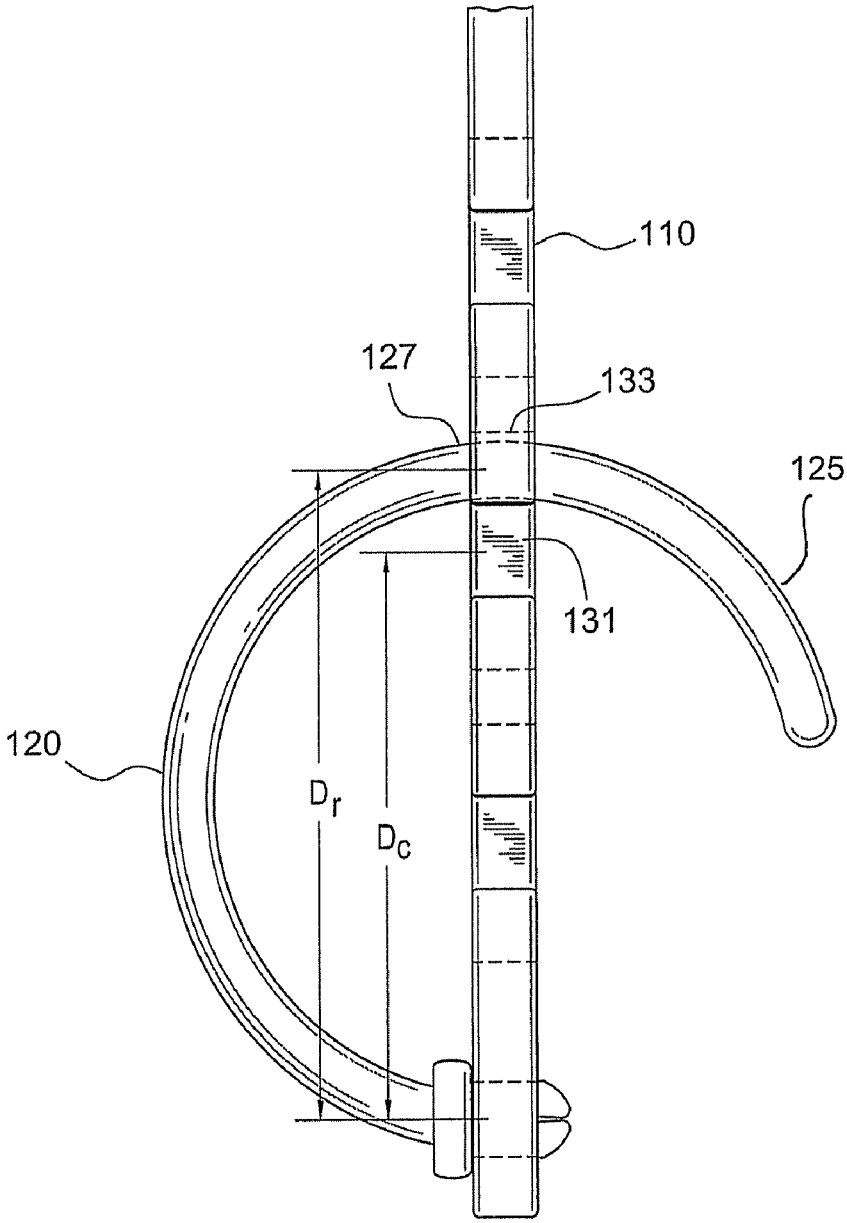
FIG. 5*b* is a partial view of the garment hanging device of FIG. 1 wherein one of the hooks is placed into its stowed position within the retaining portion of one of the receptacles.

In the relaxed state, as shown in FIG. 5*b*, a distance $D_r$ between the coupling end 121 and the apex portion 127 is greater or less than the distance $D_c$ between the pivot point 119 and the receiving portion 131 of the corresponding receptacle 130.

Hence, a hook 120, beginning in it's deployed position, may be flexed into its flexed state and pivoted to pass the apex portion 127 through the receiving portion 131, locating the apex portion 127 within the retaining portion. When the hook 120 is then returned to its relaxed state, the apex portion 127 will be retained in the retaining portion 133, at a position out of alignment with the receiving portion 131, such that the hook 120 is retained in a stowed position as shown in FIG. 5*b*.

Conversely, once in the stowed position, the hook 120 may be flexed into its flexed state (thereby aligning the apex portion 127 with the receiving portion) and pivoted to remove the apex portion 127 from the receiving portion 131, passing the apex portion 127 through the receiving portion 131 to a deployed position wherein the hook 120 may be used for example to hang the garment hanging device on a closet rod 200, as seen in FIGS. 1 and 2.

In addition to the illustrated embodiment, wherein two hooks are provided, a single hook may be used in an embodiment that is used only in the vertically hanging orientation, as in FIG. 2.

The bar 110 and hooks 120 may be formed of any suitable material. In a preferred embodiment, the bar 110 and hooks 120 are formed of a molded resilient flexible plastic material, resulting in a low manufacturing cost. While it may be advantageous that the bar 110 and hooks 120 are formed from the same material, different materials may be used. For example, the bar 110 may be formed of a rigid material, while the hooks 120 are formed of a flexible and resilient material allowing the hooks 120 to be moved between the flexed and relaxed positions.

Figure 6:
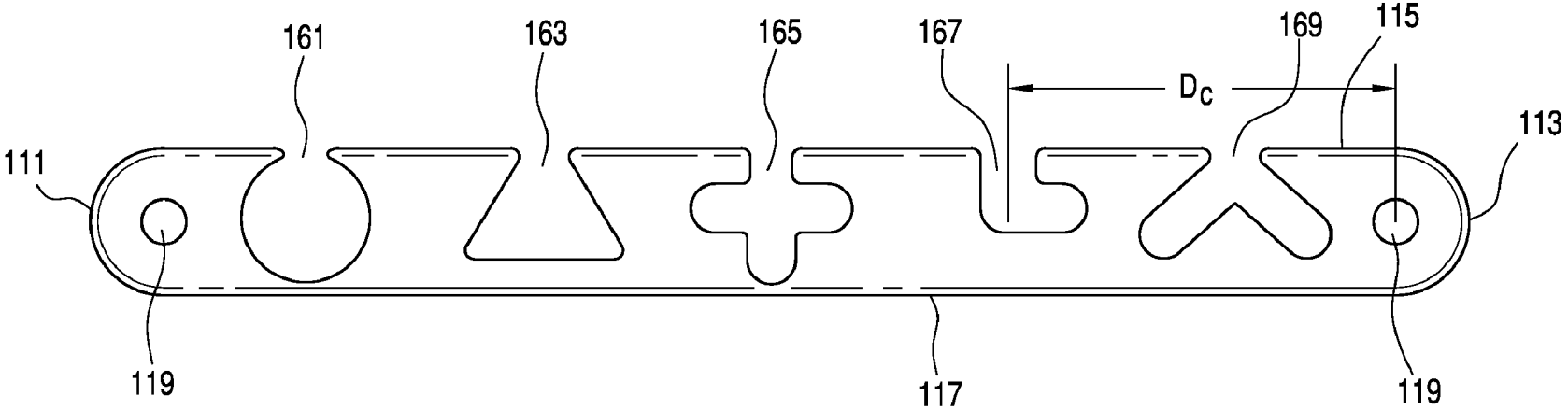
FIG. 6 is a side view of a hanging device showing alternatively shaped receptacles.

Referring to FIG. 6, alternatively shaped receptacles 161, 163, 165, 167 and 169 are shown. For example, the receptacles may be circular 161, triangular 163, "L" shaped 165, "+" shaped 167, or other shapes.

It is to be understood that the present invention is not limited to the embodiments described above, but encompasses any and all embodiments within the scope of the following claims.

I claim:

1. A garment hanging device, comprising:

an elongated bar having first and second ends, and top and bottom edges extending between said first and second ends in a longitudinal direction of said elongated bar, and at least one pivot socket formed laterally into or through said elongated bar near one of said first and second ends;

a plurality of receptacles defined in said elongated bar, each of said receptacles having a receiving portion open at the top edge of said elongated bar and a retaining portion between said top and bottom edges being connected with said receiving portion, the receiving portion having a length in said longitudinal direction configured to receive a garment hanger, the retaining portion being configured to retain a hanging garment hanger when said elongated bar is oriented in either of a substantially vertical position or a substantially horizontal position; and at least one hook having a coupling end pivotably coupled to said at least one pivot socket and a hooking portion extending from the coupling end through an apex portion of the hook opposite said coupling end to a terminal end, wherein the hooking portion is configured to be hooked over a closet rod or the like for hanging the garment hanging device;

said hook being movable between a deployed position in which the hook is freely pivotable and a stowed position in which the apex portion of the hook is disposed within the retaining portion of a corresponding one of said receptacles and out of alignment with the receiving portion of the corresponding receptacle such that in the stowed position the hook is prevented from being pivoted away from moving through the receiving portion and the elongated bar.

2. The garment hanging device according to claim 1, wherein the retaining portion of said receptacles have a length in said longitudinal direction greater than the length of said receiving portion.

3. The garment hanging device according to claim 1, wherein said retaining portion is a slot extending substantially along said longitudinal direction and said receiving portion is a slot extending from said top edge to said retaining portion in a direction substantially normal to said longitudinal direction.

4. The garment hanging device according to claim 3, wherein said receiving portion has a first length in the longitudinal direction and the retaining portion has a second length in the longitudinal direction greater than said first length.

5. The garment hanging device according to claim 1, wherein said at least one hook comprises a first hook and a second hook disposed respectively at said first and second ends of said elongated bar, wherein one of said first and second hooks is disposed in said socket.

6. The garment hanging device according to claim 1, wherein said receiving portion and said retaining portion define an inverted T shaped receptacle.

7. The garment hanging device according to claim 1, wherein said hook is removably coupled to said elongated bar.

8. A garment hanging device, comprising:

an elongated bar having first and second ends, top and bottom edges extending between said first and second ends in a longitudinal direction of said elongated bar, and at least one pivot socket formed laterally into or through said elongated bar near one of said first and second ends;

a plurality of receptacles defined in said elongated bar, each of said receptacles having a receiving portion open at the top edge of said elongated bar, and a retaining portion between said top and bottom edges being connected with said receiving portion, the receiving portion having a first length in said longitudinal direction and the retaining portion having a second length in said longitudinal direction greater than the first length such that a portion of said retaining portion extends past a side wall of said receiving portion in said longitudinal direction; and at least one hook having a coupling end pivotably coupled to said pivot socket, and a hooking portion extending from the coupling end through an apex portion of the hook opposite said coupling end to a terminal end, the hooking portion being configured to be hooked over a closet rod or the like for hanging the garment hanging device and the hook being resiliently and elastically flexible from a relaxed state to a flexed state;

wherein in said flexed state, said apex portion is positioned in alignment with the receiving portion of a corresponding one of said receptacles such that said apex portion may be moved through said receiving portion and into or out from the corresponding receptacle, and in said relaxed state said apex portion is out of alignment with the receiving portion such that said apex portion is unable to move through said receiving portion;

whereby said hook may be placed into a stowed position by flexing the hook into said flexed state, pivoting the hook to move its apex portion into the corresponding receptacle retaining portion and returning the hook into said relaxed state such that the hook cannot be pivoted away from said elongated bar and through the corresponding receiving portion.

9. The garment hanging device according to claim 8, wherein said retaining portion is a slot extending substantially along said longitudinal direction and said receiving portion is a slot extending from said top edge to said retaining portion in a direction substantially normal to said longitudinal direction.

10. The garment hanging device according to claim 8, wherein said receiving portion and said retaining portion define a substantially, inverted, T shaped receptacle.

11. The garment hanging device according to claim 8, wherein said hook is removably coupled to said elongated bar.

12. A garment hanging device, comprising:

an elongated bar having first and second ends, top and bottom edges extending between said first and second ends in a longitudinal direction of said elongated bar, and first and second pivot sockets formed laterally into or through said elongated bar respectively near said first and second ends;

a plurality of receptacles defined in said elongated bar, each of said receptacles having a receiving portion open at the top edge of said elongated bar, and a retaining portion between said top and bottom edges being connected with said receiving portion, the receiving portion having a first length in said longitudinal direction and the retaining portion having a second length in said longitudinal direction greater than the first length such that a portion of said retaining portion extends past a side wall of said receiving portion in said longitudinal direction; and a pair of hooks each having a coupling end pivotably coupled to a respective one of said first and second pivot sockets defined proximate to the ends of the elongated bar, and a hooking portion extending from the coupling end through an apex portion of the hook opposite said coupling end to a terminal end, the hooking portion being configured to be hooked over a closet rod or the like for hanging the garment hanging device and the hook being resiliently and elastically flexible from a relaxed state to a flexed state;

wherein in said flexed state, said apex portion is positioned in alignment with the receiving portion of a corresponding one of said receptacles such that said apex portion may be moved through said receiving portion and into or out from the corresponding receptacle, and in said relaxed state said apex portion is out of alignment with the receiving portion such that said apex portion is unable to move through said receiving portion;

whereby a hook may be placed into a stowed position by flexing the hook into said flexed state, pivoting the hook to move its apex portion into the corresponding receptacle retaining portion and returning the hook into said relaxed state such that the hook cannot be pivoted away from said elongated bar and through the corresponding receiving portion.

13. The garment hanging device according to claim 1, wherein the retaining portion of said receptacles is generally coincident with a longitudinal center line extending between said first and second ends of said elongated bar.

14. The garment hanging device according to claim 8, wherein the retaining portion of said receptacles is generally coincident with a longitudinal center line extending between said first and second ends of said elongated bar.

15. The garment hanging device according to claim 12, wherein the retaining portion of said receptacles is generally coincident with a longitudinal center line extending between said first and second ends of said elongated bar.

* * * * *